US010987953B2

(12) United States Patent
Bingham

(10) Patent No.: US 10,987,953 B2
(45) Date of Patent: Apr. 27, 2021

(54) RE-FEED PREVENTION

(71) Applicant: HEWLETT-PACKARD DEVELOPMENT COMPANY, L.P., Houston, TX (US)

(72) Inventor: Jeffrey G Bingham, Vancouver, WA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 105 days.

(21) Appl. No.: 15/512,127

(22) PCT Filed: Sep. 25, 2014

(86) PCT No.: PCT/US2014/057341
§ 371 (c)(1),
(2) Date: Mar. 17, 2017

(87) PCT Pub. No.: WO2016/048316
PCT Pub. Date: Mar. 31, 2016

(65) Prior Publication Data

US 2017/0274678 A1 Sep. 28, 2017

(51) Int. Cl.

| | |
|---|---|
| ***B41J 11/057*** | (2006.01) |
| ***B41J 11/06*** | (2006.01) |
| ***B41J 13/00*** | (2006.01) |

(52) U.S. Cl.
CPC ..... *B41J 11/057* (2013.01); *B41J 11/06* (2013.01); *B41J 13/0045* (2013.01)

(58) Field of Classification Search
CPC ..... B41J 11/057; B41J 11/06; B41J 13/0045; B41J 11/00; B41J 13/14
See application file for complete search history.

(56) References Cited

U.S. PATENT DOCUMENTS

| | | | | |
|---|---|---|---|---|
| 4,734,987 A * | 4/1988 | Cleveland | G01D 15/28 33/18.1 |
| 5,951,181 A * | 9/1999 | Hierro | B41J 11/005 271/264 |
| 5,993,094 A | 11/1999 | Lee | |
| 6,038,776 A * | 3/2000 | Yamada | B41J 11/0085 271/183 |
| 6,042,106 A | 3/2000 | Kelly | |
| 6,042,109 A | 3/2000 | Klausbruckner | |

(Continued)

FOREIGN PATENT DOCUMENTS

| | | |
|---|---|---|
| CN | 1096363 | 7/1998 |
| CN | 1188046 | 7/1998 |

(Continued)

*Primary Examiner* — Matthew G Marini
*Assistant Examiner* — Marissa Ferguson-Samreth
(74) *Attorney, Agent, or Firm* — HP Inc. Patent Department

(57) ABSTRACT

Examples of an apparatus to use in a media feeder and a method to use in a media feeder are disclosed herein. An example of the apparatus includes a platen having an input to receive a medium and an output to eject the medium. The example of the apparatus additional includes a re-feed prevention device including a ramp to deflect the medium away from the input of the platen when the medium exits the output of the platen and a hooked end to catch an edge of the medium when curled as the medium exits the output of the platen.

12 Claims, 6 Drawing Sheets

(56) References Cited

U.S. PATENT DOCUMENTS 6,364,554 B2 * 4/2002 Huang ..... B41J 11/005 400/636.3
6,582,072 B1 * 6/2003 Wotton ..... B41J 11/002 271/197
6,654,586 B2 11/2003 Lyon et al.
7,050,180 B1 5/2006 Bingham
7,172,354 B1 * 2/2007 Nissim ..... B41J 3/36 347/104
7,320,462 B2 1/2008 Takamatsu
7,404,558 B2 * 7/2008 Kanome ..... B65H 5/062 271/258.01
7,470,018 B2 * 12/2008 Miyazaki ..... B41J 13/106 347/101
7,503,560 B2 3/2009 Ha et al.
7,533,882 B2 5/2009 Song et al.
7,591,456 B2 9/2009 Connors et al.
7,869,755 B2 1/2011 Sano et al.
8,109,682 B2 * 2/2012 Eoka ..... B41J 2/32 400/124.01
2006/0285902 A1 12/2006 Horaguchi
2007/0059087 A1 3/2007 Kawabe et al.
2007/0121142 A1 * 5/2007 Kasai ..... G03G 21/206 358/1.12
2009/0109504 A1 4/2009 Hirokawa
2012/0081765 A1 4/2012 Takeuchi
2013/0321883 A1 * 12/2013 Fernandez ..... H04N 1/00588 358/498
2014/0168686 A1 * 6/2014 Fujiwara ..... B65H 5/00 358/1.14

FOREIGN PATENT DOCUMENTS

| | | |
|---|---|---|
| CN | 1927595 | 3/2007 |
| CN | 100532108 | 3/2007 |
| CN | 1946130 | 4/2007 |
| EP | 0653874 | 5/1995 |
| JP | H09202495 | 8/1997 |

* cited by examiner

RE-FEED PREVENTION

BACKGROUND

End users appreciate reliability and performance in their devices. They also appreciate ease of use and cost effective solutions with respect to their device needs. Designers and manufacturers may, therefore, endeavor to create and provide devices directed toward at least some of these objectives.

BRIEF DESCRIPTION OF THE DRAWINGS

The following detailed description references the drawings, wherein.

DETAILED DESCRIPTION

Media may be input into a platen, for example, to scan the media in order for it to be copied or digitized so that it may be emailed, saved, etc. The media may be subsequently retrieved, for example, at an output of the platen or a bin, tray, basket, etc.

Larger media may still be being input into a platen for scanning during the point at which it is exiting the output of the platen. The media exiting the output of the platen may inadvertently end up being re-fed into the input of the platen along with the portion of the media still awaiting scanning.

This re-feeding can cause jams to occur so that the remaining portion of the media cannot be scanned until the jam is cleared. Some end users may find this undesirable. Some end users may also find it difficult to clear such jams, resulting in additional dissatisfaction and downtime. A technician or other repair person may need to be dispatched which can require payment of fees, thereby adding to an end user's cost. This re-feeding may also result in damage to the media being scanned which is undesireable.

Examples directed to helping prevent such re-feed of media are shown in FIGS. 1-7. These examples attempt to address the above-described technical challenges associated with media re-feeding from an output of a platen to an input of the platen.

As used herein the term "printing device" represents, but is not necessarily limited to, a printer, plotter, press and/or device that utilizes printing composition (e.g., ink, toner, colorant, wax, dye, powder, latex, etc.) to create text, images, graphics, pictures and/or three-dimensional objects. A printing device may utilize any of the following marking technologies or a combination thereof: ink jet, dye sublimation, thermal transfer, 3D, laser, extrusion, off-set printing, or dot matrix. As used herein the terms "media" and "medium" are interchangeable and represent, but are not necessarily limited to, any type of paper or other printing medium (e.g., cloth, cardboard, canvas, transparency, substrate, etc.), having any type of finish on either or both sides (e.g., glossy, matte, plain, textured, etc.), in any size, shape, color, or form (e.g., sheet, roll (cut or uncut), folded, etc.) on which printing composition is placed, jetted, deposited, dropped, formed, or laid by at least one printhead.

As used herein, the term "platen" represents, but is not necessarily limited to, a surface on which media is placed to perform an operation such as scanning or printing. The media may be transported by a drive mechanism from an input of the platen to an output of the platen. A platen may have a variety of different shapes and sizes. As used herein, the terms "include", "includes", "including", "have", "has", "having" and variations thereof, mean the same as the terms "comprise", "comprises", and "comprising", or appropriate variations thereof.

Figure 1:
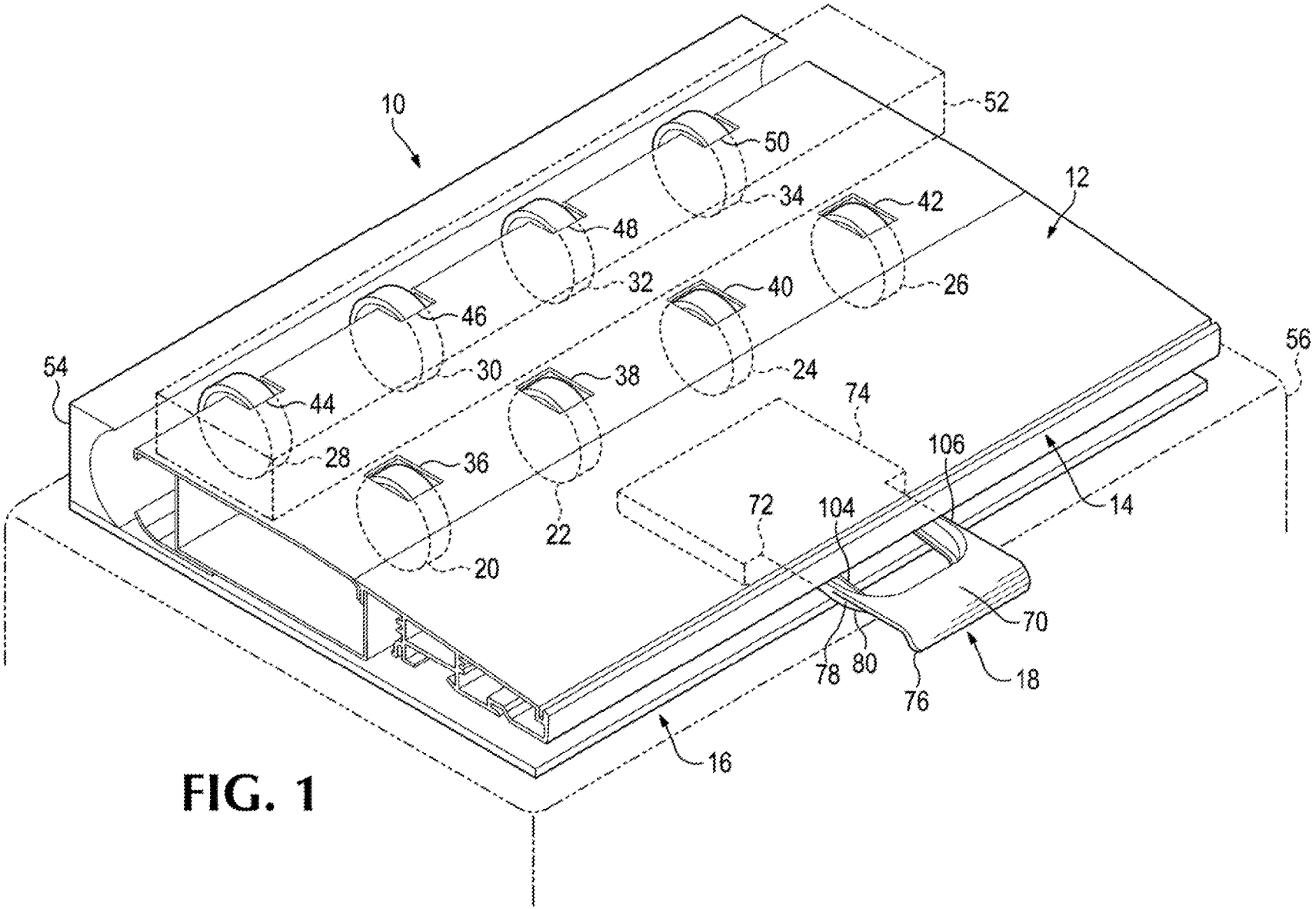
FIG. 1 is an example of an apparatus to use in a media feeder.

An example of an apparatus 10 to use in a media feeder is shown in FIG. 1. As can be seen in FIG. 1, apparatus 10 includes a platen 12 that has an input 14 to receive a medium (not shown in FIG. 1) and an output 16 to eject the medium. In this example of apparatus 10, input 14 of platen 12 is located above output 16 of platen. As discussed more fully below, apparatus 10 additionally includes a re-feed prevention device 18 that is coupled to platen 12 adjacent output 16 of platen 12. Re-feed prevention device 18 is designed both to deflect the medium away from input 14 as the medium exits output 16 of platen 12 and to catch an edge of the medium when curled as the medium exits the output of platen 12.

As can also be seen in FIG. 1, apparatus 10 may include a plurality of drive rollers 20, 22, 24, 26, 28, 30, 32, and 34 that extend through respective openings 36, 38, 40, 42, 44, 46, 48, and 50 of platen 12 to control movement of the media from input 14 to output 16. Although not shown in FIG. 1, it is to be understood that apparatus 10 may also include other components (e.g., a housing, pinch rollers, shafts, encoder(s), motor(s), etc.) to help control movement of the media from input 14 to output 16, as well as to enclose apparatus 10. It is also to be understood that in other examples, apparatus 10 may include a different number of drive rollers.

As can additionally be seen in FIG. 1, apparatus 10 may also include a scanner 52 past which the media is transported along platen 12 by drive rollers 20, 22, 24, 26, 28, 30, 32, and 34 and a media guide 54 which directs the media from input 14 of platen 12 toward output 16 of platen 12. As can further be seen in FIG. 1, apparatus 10 may be a component of and utilized by a printing device 56 by, for example, coupling platen 12 to printing device 56.

Figure 2:
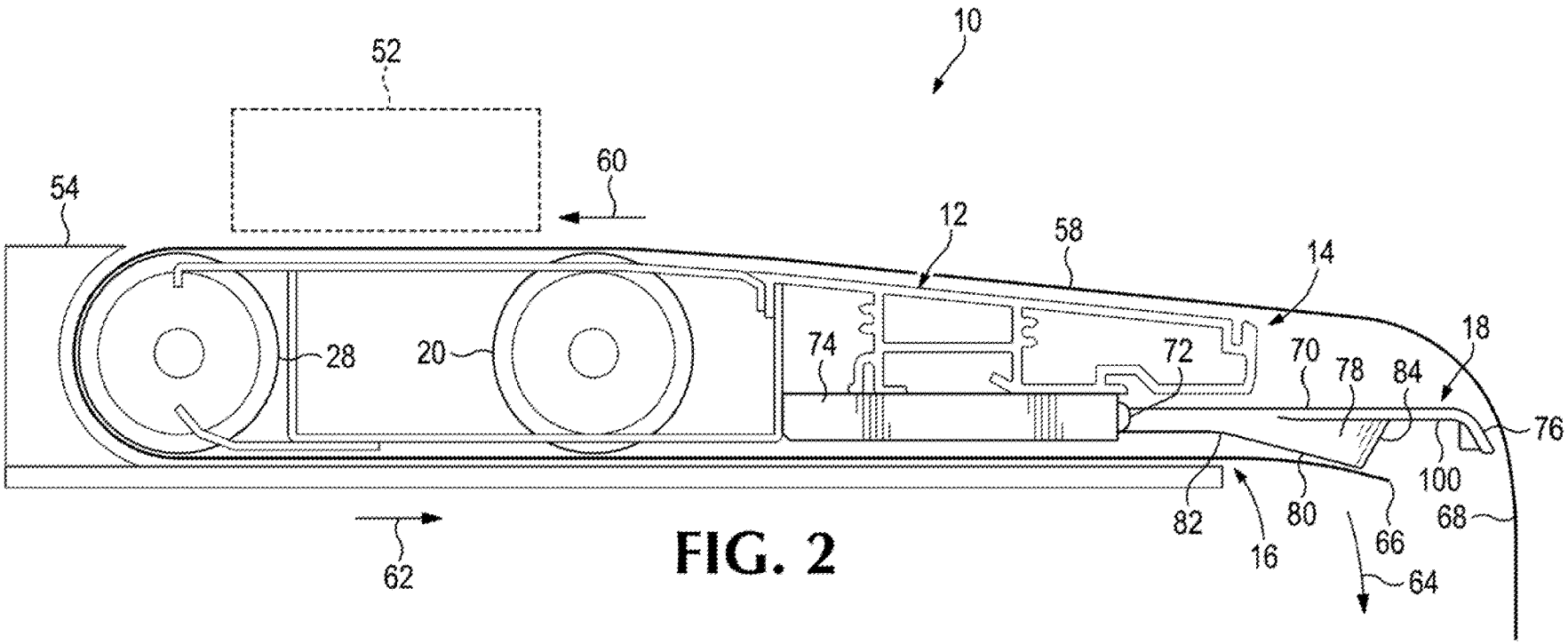
FIG. 2 is an example of a side view of the apparatus of FIG. 1.

An example of a side view of apparatus 10 is shown in FIG. 2. As can be seen in FIG. 2, a medium 58 has been loaded onto platen 12 at input 14 and is being transported past scanner 52 via drive rollers 20, 22, 24, 26, 28, 30, 32, and 34 (two of which are shown in FIG. 2, i.e., drive rollers 20 and 28) in the direction of arrow 60. Medium 58 then encounters media guide 54 which, along with drive rollers 28, 30, 32, and 34, reverse the direction of travel of medium 58 from the direction of arrow 60 to the direction indicated by arrow 62 so that medium 58 may be ejected at output 16 of platen 12. As can also be seen in FIG. 2, re-feed prevention device 18 is in an extended position and is deflecting medium 58 in a downward direction indicated by arrow 64 away from input 14 of platen 12 where it may be collected, for example, in a bin, tray or basket (not shown).

Re-feed prevention device 18 helps to prevent end 66 of medium 58 from contacting trailing portion 68 of medium 58 by deflecting end 66 downward in the direction of arrow 64. This contact between end 66 of medium 58 and trailing portion 68 of medium 58 might otherwise occur without re-feed prevention device 18 due to, for example, the stiffness of medium 58. If this contact between end 66 of medium 58 and trailing portion 68 of medium 58 does occur, it may cause a transport error of medium 58 past scanner 52 by drive rollers 20, 22, 24, 26, 28, 30, 32, and 34 which can result in an inaccurate scanning of medium 58. Additionally or alternatively, contact between end 66 of medium 58 and trailing portion 68 of medium 58 may result in end 66 being re-fed into input 14 of platen 12. As discussed above, such a re-feed may cause a am that needs to be cleared and may also damage medium 58, both of which are undesirable.

As can additionally be seen in FIG. 2, re feed prevention device 18 includes a body 70 that has a proximal end 72 coupled to platen 12 via tray 74 and a distal depending or hooked end 76. Re-feed prevention device 18 also includes a deflection rib 78 between proximal end 72 and distal depending or hooked end 76 that deflects medium 58 away from input 14 of platen 12 as medium 58 exits output 16 of platen 12. In this example of re feed prevention device 18, deflection rib 78 includes a ramp 80 to deflect medium 58 away from input 14 of platen 12 as medium 58 exits output 16 of platen 12. Ramp 80 helps to provide a uniform downward slope beginning at point 82 of body 70 to facilitate deflection of medium 58 in the direction of arrow 64. Ramp 80 includes an end 84 that depends below distal depending or hooked end 76 that helps prevent stiffer media, such as medium 58, from traveling past end 84 of ramp 80 and being inadvertently caught by distal depending or hooked end 76.

Figure 3:
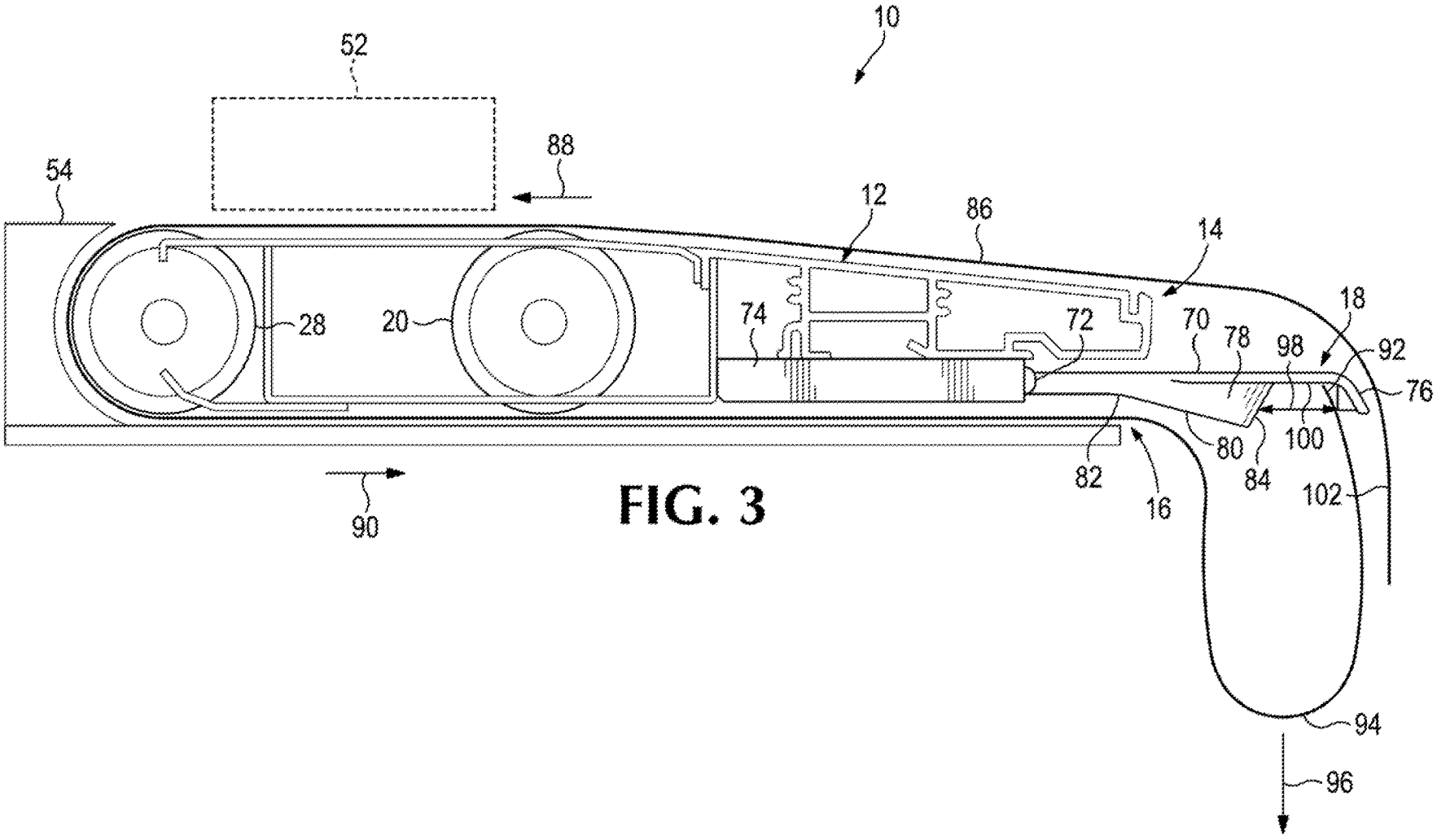
FIG. 3 is another example of a side view of the apparatus of FIG. 1.

Another example of a side view of apparatus 10 is shown in FIG. 3. As can be seen in FIG. 3, a medium 86 has been loaded onto platen 12 at input 14 and is being transported past scanner 57 via drive rollers 20, 22, 24, 26, 28, 30, 32, and 34 (two of which are shown in FIG. 3, i.e., drive rollers 20 and 28) in the direction of arrow 88. Medium 86 then encounters media guide 54 which, along, with drive rollers 28, 30, 32, and 34, reverse the direction of travel of medium 86 from the direction of arrow 88 to the direction indicated by at row 90 so that medium 86 may be ejected at output 16 of platen 12. As can also be seen in FIG. 3, re-feed prevention device 18 is in an extended position and is catching an curled edge 92 of medium 86 as medium 86 exits output 16 of platen 12. As medium 86 continues to be advanced by drive rollers 20, 22, 24, 26, 28, 30, 32, and 34, a buckle or sag 94 develops that eventually becomes large enough to cause curled end 92 to release from distal depending or hooked end 76 which allows medium 86 to fall downward in the direction indicated by arrow 96 away from input 14 of platen 12 where it may be collected, for example, in a bin, tray or basket (not shown).

As can additionally be seen in FIG. 3, distal depending or hooked end 76 is separated from end 84 a predetermined distance, generally indicated by double-headed arrow 98, to define a recess 100 to receive curled edge 92 of medium 86 caught by distal depending or hooked end 76 as medium 86 exits output 16 of platen 12. Recess 100 helps allow a portion of medium 86 to accumulate therein as buckle or sag 94 initially develops and increases in size until medium 86 falls in the direction of arrow 96. The size of recess 100 may be increased or decreased by respectively increasing or decreasing the extent of the predetermined distance, generally indicated by double-headed arrow 98.

Distal depending or hooked end 76 of re-feed prevention device 18 helps to prevent curled end 92 of medium 86 from contacting trailing portion 102 of medium 86 by catching it as it exits output 16 of platen 12. This contact between curled end 92 of medium 86 and trailing portion 102 of medium 86 might otherwise occur without re-feed prevention device 18 due to, for example, an upward curl of medium 86 toward platen 12. If this contact between curled end 92 of medium 86 and trailing portion 102 of medium 86 does occur, it may cause a transport error of medium 86 past scanner 52 by drive rollers 20, 22, 24, 26, 28, 30, 32, and 34 which can result in an inaccurate scanning of medium 86. Additionally or alternatively, contact between curled end 92 of medium 86 and trailing portion 102 of medium 86 may result in curled end 92 being re-fed into input 14 of platen 12. As discussed above, such a re-feed may cause a jam that needs to be cleared and may also damage medium 86, both of which are undesirable.

Figure 4:
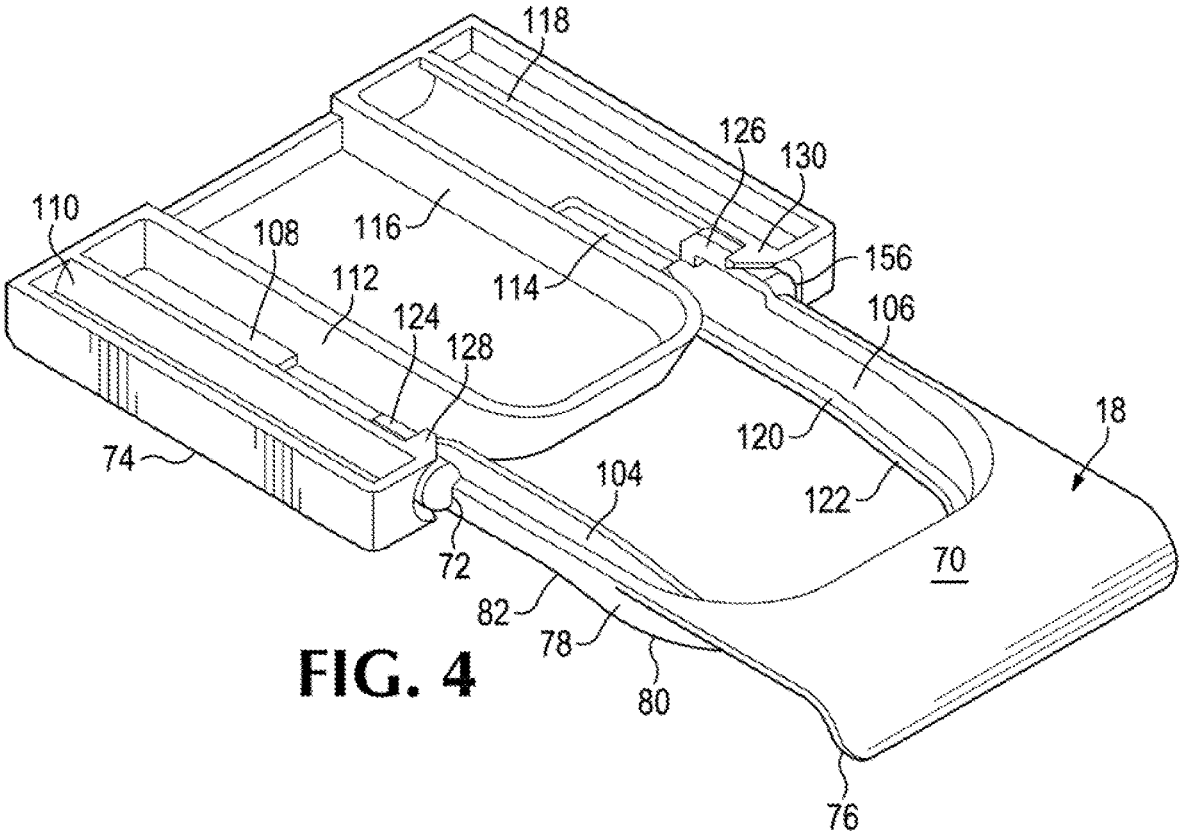
FIG. 4 is an isometric view of an example of a re-feed prevention device in an extended position.

An isometric view of an example of re-feed prevention device 18 in an extended position to deflect and catch media as it exits output 16 of platen 12 is shown in FIG. 4. As can be seen in FIG. 4, body 70 of re-feed prevention device 18 includes a first arm 104 and a second arm 106. As can additionally be seen in FIG. 4, tray 74 includes a first track 108 defined by walls 110 and 112 in which first arm 104 is disposed and a second track 114 defined by walls 116 and 118 in which second arm 106 is disposed. First and second tracks 108 and 114 allow respective first and second arms 104 and 106 to translate between the extended position shown in FIG. 4 to the retracted position shown in FIG. 5. The retracted position of re-feed prevention device 18 shown in FIG. 5 may be useful when initially loading a medium into input 14 of platen 12 so that re-feed prevention device 18 is out of the way of an end user. Once a medium is loaded, re-feed prevention device 18 may be extended to the position shown in FIG. 4 so that re-feed prevention device 18 may deflect or catch the medium as it exits output 16 of platen 12, as described above.

As can further be seen in FIG. 4, second arm 106 of re-fed prevention device 18 includes a second deflection rib 120 that has a second ramp 122 to deflect media away from input 14 of platen 12, as discussed above, with respect to deflection rib 78 and ramp 80. First and second arms 104 and 106 also include respective raised members 124 and 126. Raised members 124 and 126 engage respective protrusions 128 and 130 of tray 74 when re-feed prevention device 18 is in the extended position to help keep re-feed prevention device 18 attached to tray 74.

Figure 6:
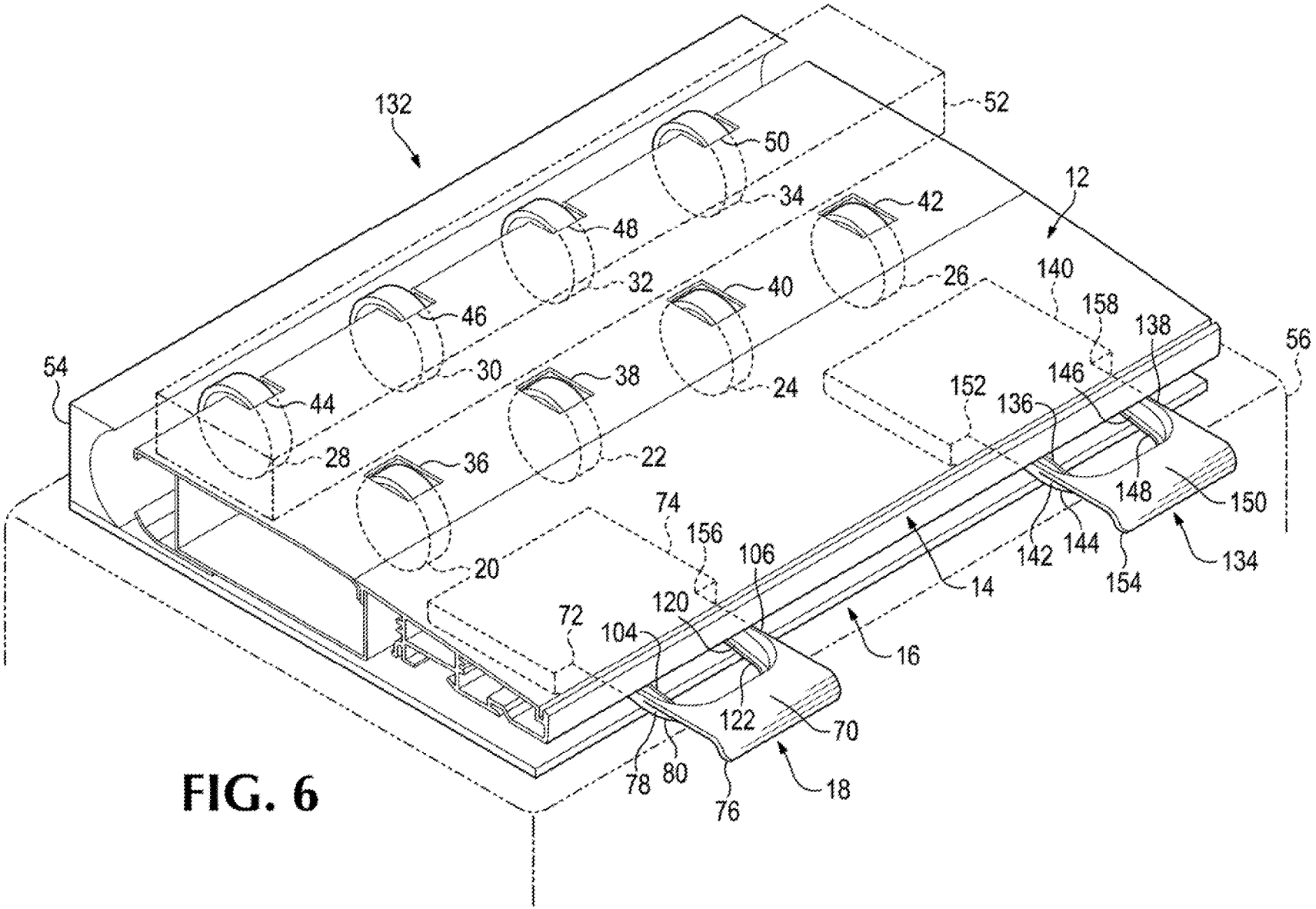
FIG. 6 is another example of an apparatus to use in a media feeder.

Another example of an apparatus 132 to use in a media feeder is shown in FIG. 6. Where possible, the same reference numerals have been used in FIG. 6 for the components, elements, and features of apparatus 132 that are the same as those of apparatus 10. As can be seen in FIG. 6, apparatus 132 includes a second re-feed prevention device 134 coupled to platen 12 adjacent output 16. Like re-feed prevention device 18, second re-feed prevention device 134 is designed to deflect a medium away from input 14 of platen 12 when media exits output 16 of platen 12 and to catch an edge of a medium when curled as the medium exits output 16 of platen 12.

Figure 5:
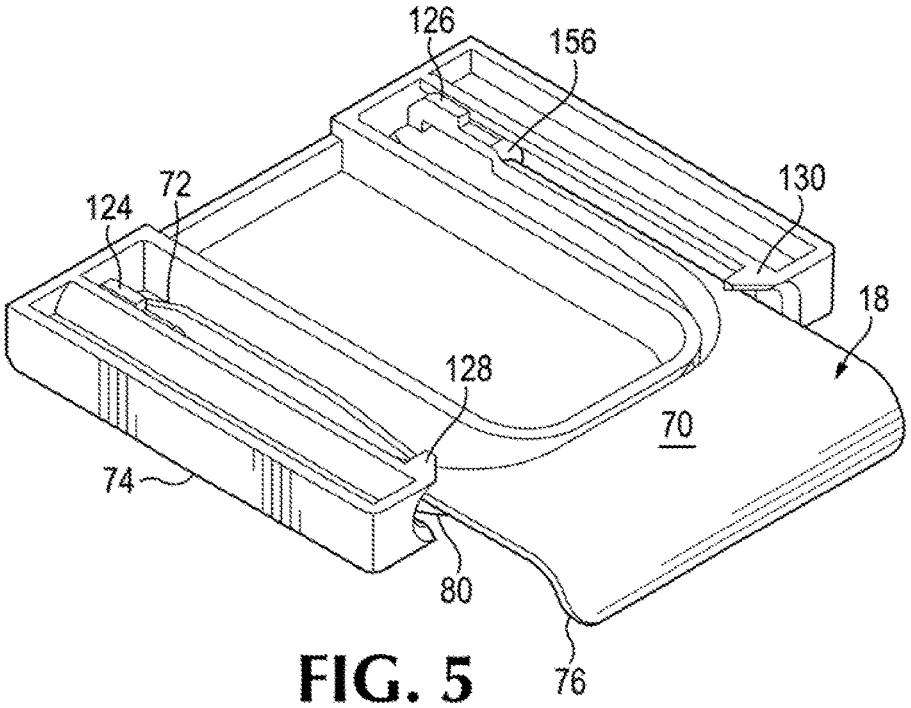
FIG. 5 is an isometric view of an example of the re-feed prevention device of FIG. 4 in a retracted position.

As can also be seen in FIG. 6, second re-feed prevention device 134 includes a first arm 136 and a second arm 138 that are received in respective first and second tracks (not shown in FIG. 6) of tray 140 to allow first and second arms 136 and 138 to translate between an extended position shown in FIG. 6 and a retracted position (not shown in FIG. 6) like re-feed prevention device 18 shown in FIG. 5. Although not shown in FIG. 6, it is to be understood that first and second arms 136 and 138 also include respective raised members that engage respective protrusions of tray 140 when re feed prevention device 134 is in the extended position to help keep re-feed prevention device 134 attached to tray 140.

As can additionally be seen in FIG. 6, second re-feed prevention device 134 includes a third deflection rib 142 that has a third ramp 144 to deflect media away from input 14 of platen 12, as discussed above, for example, with respect to deflection ribs 78 and 120 and respective ramps 80 and 122 of re-feed prevention device 18. Second re-feed prevention device 134 additionally includes a fourth deflection rib 146 that has a fourth ramp 148 to deflect media away from input 14 of platen 12, also discussed above, for example, with respect to deflection ribs 78 and 120 and respective ramps 80 and 122 of re-feed prevention device 18.

As can further be seen in FIG. 6, second re-feed prevention device 134 includes a body 150 that has a proximal end 152 coupled to platen 12 via tray 140 and a distal depending or hooked end 154 to catch a curled end of a medium (not shown in FIG. 6) when the medium exits output 16 of platen 12 to help prevent the medium from being re-fed into input 14 of platen 12, as discussed above, for example, with respect to distal depending or hooked end 76. As can still further be seen in FIG. 6, third deflection rib 142 and third ramp 144 are located between proximal end 152 and distal depending or hooked end 154. Similarly, second deflection rib 120 and second ramp 122 are located between proximal end 156 and distal depending or hooked end 76, and fourth deflection rib 146 and fourth ramp 148 are located between proximal end 158 and distal depending or hooked end 154.

Although not shown in FIG. 6, it is to be understood that distal depending or hooked end 154 of second re-feed prevention device 134 is separated from ends (not shown) of third and fourth ramps 144 and 148 to define a recess, like recess 100 of re-feed prevention device 18, to receive a curled edge of a medium caught by distal depending or hooked end 154 as the medium exits output 16 of platen 12. As can yet further be seen in FIG. 6, apparatus 132 may be a component of and utilized by a printing device 56 by, for example, coupling platen 12 to printing device 56.

Figure 7:
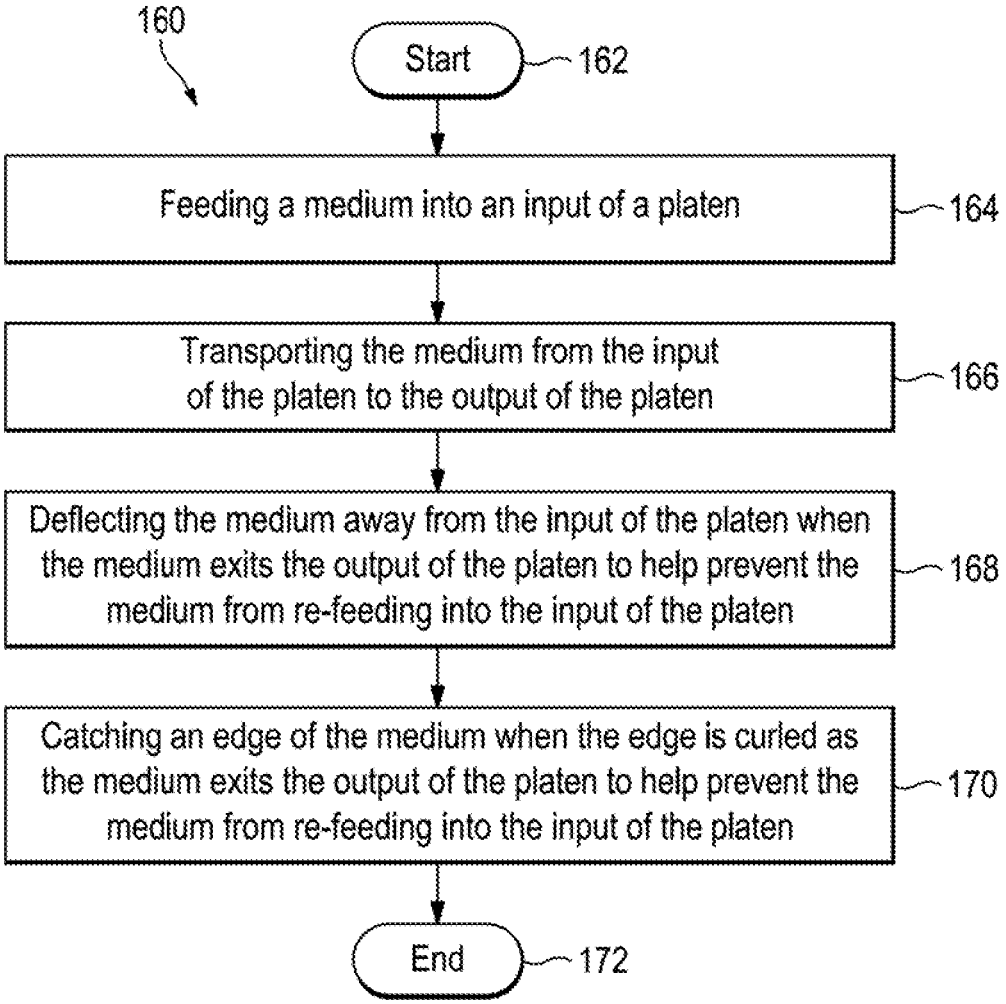
FIG. 7 is an example of a method to use in a media feeder.

An example of a method 160 to use in a media feeder is shown in FIG. 7. As can be seen in FIG. 7, method 160 starts 162 by feeding a medium into an input of a platen, as indicated by block 164, and transporting the medium from the input of the platen to the output of the platen, as indicated by block 166. Method 160 continues by deflecting the medium away from the input of the platen when the medium exits the output of the platen to help prevent the medium from re-feeding into the input of the platen, as indicated by block 168, and catching an edge of the medium when the edge is curled as the medium exits the output of the platen to help prevent the medium from re-feeding into the input of the platen, as indicated by block 170. Method 160 may then end 172.

Although several drawings have been described and illustrated in detail, it is to be understood that the same are intended by way of illustration and example. These examples are not intended to be exhaustive or to be limited to the precise form disclosed. Modifications and variations may well be apparent. For example, input 14 and/or output 16 of platen 12 may be in a different location. As another example, re-feed prevention device 18 may include either a deflection rib or a ramp to deflect media away from the input of a platen as the media exits the output of the platen, rather than deflection ribs 78 and 120 that include respective ramps 80 and 122. As an additional example, although use of a single re-feed prevention device 18 and two re-feed prevention devices 18 and 134 have been illustrated, it is to be understood that other implementations may utilize more than two re-feed prevention devices.

Additionally, reference to an element in the singular is not intended to mean one, unless explicitly so stated, but rather means at least one. Furthermore, unless specifically stated, any method elements are not limited to the sequence or order described and illustrated. Moreover, no element or component is intended to be dedicated to the public regardless of whether the element or component is explicitly recited in the following claims.

What is claimed is:

1. An apparatus to use in a media feeder, comprising:

a platen including an input to receive a medium and an output to eject the medium; and a re-feed prevention device comprising a body including;

a ramp, disposed above a media transport path at the output of the platen where the medium is ejected from the platen, to deflect a leading edge of the medium that has exited the output of the platen and subsequent portions of the medium downward and away from the input of the platen, a hooked end to catch an edge of the medium when curled as the medium exits the output of the platen, and a recess between the hooked end and the ramp in which to receive the edge of the medium which is curling upwards after being directed downward by the ramp; and a tray attached to the platen, wherein the body of the re-feed prevention device is coupled to the tray to translate therein between an extended position to deflect and catch the medium as the medium exits the output of the platen and a retracted position, and wherein the body of the re-feed prevention device includes a first arm and a second arm, and further wherein the tray includes a first track in which the first arm is disposed and a second track in which the second arm is disposed.

2. The apparatus of claim 1, wherein the input of the platen is located above the output of the platen.

3. The apparatus of claim 1, further comprising a second re-feed prevention device including a second ramp to deflect the medium away from the input of the platen when the medium exits the output of the platen and a second hooked end to catch a curled end of the medium when the medium exits the output of the platen.

4. The apparatus of claim 1, further comprising a printing device coupled to the platen.

5. The apparatus of claim 1, wherein the ramp includes an end that depends below the hooked end.

6. An apparatus to use in a media feeder, comprising:

a platen including an input to receive a medium and an output to eject the medium;

a re-feed prevention device including a body having a proximal end coupled to the platen and a distal depending end to catch an edge of the medium when curled as the medium exits the output of the platen, the re-feed prevention device additionally including a deflection rib between the distal depending end and the proximal end of the body to deflect the medium away from the input of the platen when the medium exits the output of the platen, wherein the deflection rib hangs from an underside of the re-feed prevention device and comprises a ramp that is angled downward from the output of the platen to direct medium exiting the platen downward with respect to the platen; and a tray attached to the platen, wherein the body of the re-feed prevention device is coupled to the tray to translate therein between an extended position to deflect and catch the medium as the medium exits the output of the platen and a retracted position, and wherein the body of the re-feed prevention device includes a first arm and a second arm, and further wherein the tray includes a first track in which the first arm is disposed and a second track in which the second arm is disposed.

7. The apparatus of claim 6, wherein the deflection rib includes a ramp having an end that depends below the distal depending end of the body.

8. The apparatus of claim 6, further comprising a second re-feed prevention device including a second body having a second proximal end coupled to the platen and a second distal depending end to catch a curled end of the medium when the medium exits the output of the platen, the re-feed prevention device additionally including a second deflection rib between the second distal end and the second proximal end of the second body to deflect the medium away from the input of the platen when the medium exits the output of the platen.

9. The apparatus of claim 6, wherein the distal depending end of the body is separated a predetermined distance from an end of the rib to define a recess to receive the edge of the medium when curled as the medium exits the output of the platen.

10. The apparatus of claim 6, further comprising a raised member on either the first or second arm to engage a respective protrusion of the tray to retain that arm in the corresponding track of the tray.

11. The apparatus of claim 6, wherein the distal depending end comprises a hook to receive the edge of the medium which is curling upwards after being directed downward by the ramp.

12. A method to use a media feeder, comprising:

feeding a medium into an input of a platen that includes an input to receive a medium and an output to eject the medium;

transporting the medium from the input of the platen to the output of the platen;

deflecting the medium away from the input of the platen when the medium exits the output of the platen with a re-feed prevention device including a body having a proximal end coupled to the platen and a distal depending end to catch an edge of the medium when curled as the medium exits the output of the platen, the re-feed prevention device additionally including a deflection rib between the distal depending end and the proximal end of the body to deflect the medium away from the input of the platen when the medium exits the output of the platen, wherein the deflection rib hangs from an underside of the re-feed prevention device and comprises a ramp that is angled downward from the output of the platen to direct medium exiting the platen downward with respect to the platen; and wherein the body of the re-feed prevention device is coupled to a tray attached to the platen, the method further comprising translating the body of the re-feed prevention device with respect to the tray between an extended position to deflect and catch the medium as the medium exits the output of the platen and a retracted position, and wherein the body of the re-feed prevention device includes a first arm and a second arm, and further wherein the tray includes a first track in which the first arm is disposed and a second track in which the second arm is disposed.

* * * * *